US006786062B1

(12) United States Patent
Greenberg

(10) Patent No.: US 6,786,062 B1
(45) Date of Patent: Sep. 7, 2004

(54) BEVERAGE COOLING DEVICE

(76) Inventor: Harry R. Greenberg, 997 E. Washington St., Medina, OH (US) 44256

( * ) Notice: Subject to any disclaimer, the term of this patent is extended or adjusted under 35 U.S.C. 154(b) by 0 days.

(21) Appl. No.: 10/300,164

(22) Filed: Nov. 20, 2002

Related U.S. Application Data

(60) Provisional application No. 60/331,858, filed on Nov. 20, 2001.

(51) Int. Cl.[7] ..... F25D 3/08
(52) U.S. Cl. ..... 62/457.4; 62/457.5
(58) Field of Search ..... 62/457.4, 457.3, 62/530, 457.5

(56) References Cited

U.S. PATENT DOCUMENTS 3,302,427 A * 2/1967 Stoner et al. ..... 62/457.4
3,302,428 A * 2/1967 Stoner et al. ..... 62/457.4
3,603,106 A * 9/1971 Ryan et al. ..... 62/457.4
4,383,422 A * 5/1983 Gordon et al. ..... 62/457.4
4,782,670 A * 11/1988 Long et al. ..... 62/457.4
4,963,175 A * 10/1990 Pace ..... 62/372
5,845,499 A * 12/1998 Montesanto ..... 62/48.1
5,924,304 A * 7/1999 Sanchez ..... 62/457.7
6,065,303 A * 5/2000 Harris ..... 62/457.5
6,065,609 A * 5/2000 Lake ..... 210/474
6,094,935 A * 8/2000 Stein ..... 62/457.3
6,101,838 A * 8/2000 Teague ..... 62/457.4
6,196,017 B1 * 3/2001 Chapman ..... 62/372
6,244,065 B1 * 6/2001 Wuestman ..... 62/457.6
6,276,163 B1 * 8/2001 Broadbent ..... 62/457.4
6,357,253 B1 * 3/2002 Condy ..... 62/457.8
6,443,096 B1 * 9/2002 Prydie ..... 119/61

FOREIGN PATENT DOCUMENTS

EP WO92/04586 * 3/1992

* cited by examiner

*Primary Examiner*—William E. Tapolcai
*Assistant Examiner*—Mohammad M. Ali
(74) *Attorney, Agent, or Firm*—Renner, Otto, Boisselle & Sklar, LLP

(57) ABSTRACT

A beverage coaster for cooling a beverage is disclosed. The beverage coaster includes a base having the approximate size of a standard beverage can. The base includes a top wall having a radial curve contoured to engage a bottom portion of the beverage can. At least one side wall is connected to the bottom wall and to the top wall, and the height of the side wall is less than the width of the base. A predetermined amount of cooling material is disposed between the top wall and the bottom wall.

6 Claims, 1 Drawing Sheet

BEVERAGE COOLING DEVICE

This application claims the benefit of provisional application No. 60/331,858, filed Nov. 20, 2001.

TECHNICAL FIELD

The present invention generally relates to a cooling device for a beverage container. Specifically, the device allows a user to insert the bottom of a beverage container into a pre-formed cavity designed to accept the varying contours of the container's bottom. As a result, the beverage container is stabilized, while the unconsumed portion of the beverage is kept cold until consumed by the user.

BACKGROUND OF THE INVENTION

Typically, a user imbibes a cold beverage over the course of a period of time sufficient to allow a remaining portion of the unconsumed beverage to become warm. As this remaining portion of the beverage becomes warm, its taste may become displeasing, and as a result the user is likely to discard the remaining portion of the beverage. To keep this remaining portion of the beverage from becoming warm, a system for maintaining a cold temperature at the lower region of the beverage can is needed.

Therefore, in light of the foregoing deficiencies in the prior art, the applicant's invention is herein presented.

SUMMARY OF THE INVENTION

The present invention is directed to a beverage cooler designed to receive the contoured bottom portion of a beverage container. This beverage cooler is comprised of an outer wall, and a hollow platform having an inner wall that comprises a contoured cavity. Furthermore, cooling material is located within the hollow area bounded by the inner and outer walls of the present invention. As a result, the user is able to insert its beverage container into the present invention, and as time passes the remaining portion of the unconsumed beverage is kept cooled.

In some embodiments, an detachable base suitable for contacting a table or other similar supporting surface may be attached to the present invention.

In some embodiments, the inner and outer walls may be formed as a single unified section.

In some embodiments, an elevated base section could be attached to the bottom of the present invention.

In some embodiments, the inner wall may be thinner than the outer wall.

In some embodiments, the outer wall could be thicker than the inner wall.

In some embodiments, the inner and outer walls could be longitudinally extended.

In some embodiments, a support base is attached to the bottom of the outer wall of the present invention.

DETAILED DESCRIPTION

Figure 1:
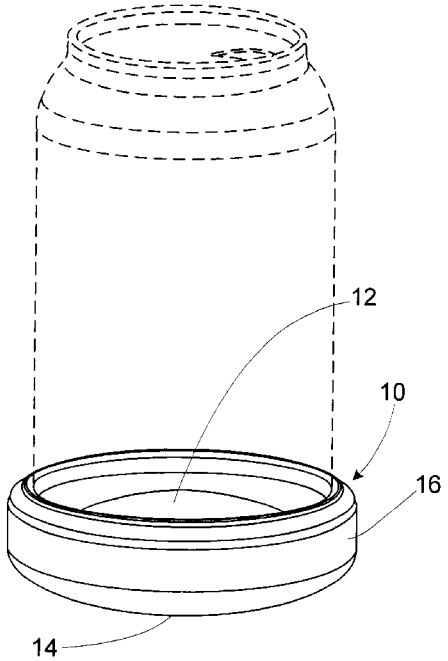
FIG. 1 is a perspective view of the present invention in use with a beverage container.
Figure 2:
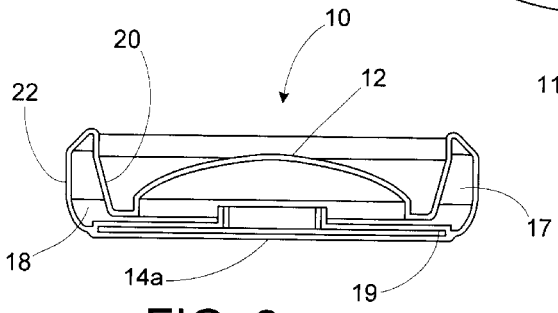
FIG. 2 is a side cross-sectional view of the present invention, illustrating the cavity in which material for keeping a beverage cooled is located.

FIG. 1 shows a perspective view of a beverage base cooler 10. The cooler 10, is illustrated as substantially circular in shape, and comprises a platform having a contoured cavity 12 for receiving a beverage container, and a base surface 14. The platform 16 is comprised of an inner and outer wall 20, 22 as shown in FIG. 2. One of skill in this art would understand that the overall shape of the present invention 10 may be comprised of any shape and size suitable for a container to be used in conjunction with the present invention. The beverage cooling device of the present invention can correspond generally to a variety of beverage containers or can be specifically designed for use in conjunction with certain types of beverage containers or particular containers.

The inner and outer walls 20, 22 of the present invention may be formed from synthetic or natural materials which include but are not limited to aluminum, steel, plastics, foams or any other suitable material. It is also contemplated that the materials chosen for the inner and outer walls 20, 22 possess thermal transfer characteristics desirable for a beverage cooler. Furthermore, the contoured cavity 12 may be pre-formed to any specific shape so that it may engage the specific shape of the corresponding beverage container's bottom.

Turning to FIG. 2, the contoured cavity 12 of the present invention 10 is comprised of an inner wall 20 that is designed to generally correspond in shape to that of the bottom of a beverage container. As a result, the surface area that is in contact between the bottom of the beverage container and the contoured cavity 12 is increased. An additional advantage of the contoured cavity 12, is that it provides additional lateral support to the beverage container, thereby increasing the container's resistance to being toppled over. Opposing the contoured cavity 12, is a base surface 14, which is designed to contact a table or other suitable support surface. The base surface 14 may be formed from the same material as the platform 16, as a result the outer wall 22 would serve as the base surface 14 as well. It is also contemplated that the base 14 may be composed of material such as cork, rubber, plastic, or any other similar material. Furthermore, the outer wall 22, inner wall 20, and base 14 of the present invention may be formed from a single unified section of material or from discrete sections joined together.

Additionally, FIG. 2 illustrates a side cross-sectional view of the invention in which cooling material 18, having suitable characteristics to keep a beverage cooled, is disposed within the cavity 17 bounded by the inner and outer walls 20, 22 of the present invention 10. This cooling material may consist of material such as frozen water, refrigerant gel, refrigerant gel sold under the trademark ELUE ICE®, or any other aqueous solution possessing a slow phase change known in the art. It is also contemplated that this cooling material 18 may be inserted into the cavity 17 by the user via an insertion port located within the present invention, or as a step in the manufacturing process.

The contoured cavity 12 is designed so that the bottom of the liquid holding container and the surface of the contoured cavity 12 share a large amount of common surface area. As a result, the thermal transfer between the present invention 10 and the beverage container is increased and beverage coolness is enhanced. Located at the bottom of the platform's 16 outer wall 20 is an optional recessed region 19. Within the recessed region 19, an optional alternative base surface 14*a* may be attached within the recessed region 19 via adhesives, staples, or any other similar method of connecting the base 14 to the recessed region 19. This base surface 14*a* may be formed from material such as cork, rubber, polymeric material, or any other material suitable for a beverage cooler base.

It is also contemplated that the outer wall 22 of the present invention 10 may have an increased cross-sectional thickness, than the inner-wall 20, and serves to further isolate the cooling material 18 disposed within the cavity 17 from the surrounding external environment. As a result, the coldness of the cooling material 18 is not as readily thermally transferred to the external environment, thereby providing increased cooling capacity to the beverage container inserted within the present invention 10. Additionally, the inner wall 20 may be designed to have a thinner cross-sectional area than the outer wall 22. This provides for increased thermal transfer between the cooling material 18 within the contoured cavity 12 and the beverage container.

Figure 4:
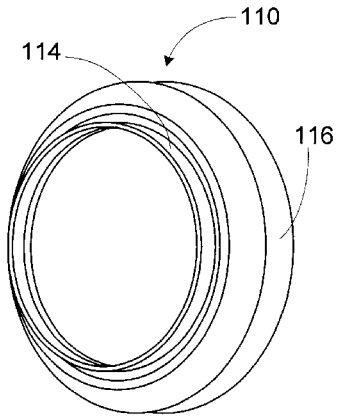
FIG. 4 is a bottom perspective view of a further embodiment of the present invention having an elevated base section.
Figure 3:
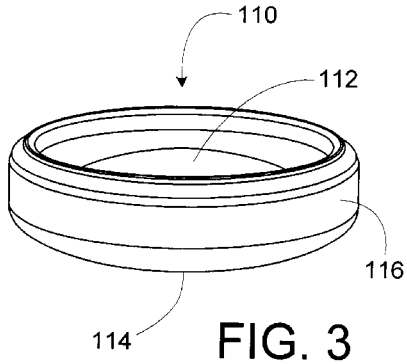
FIG. 3 is a perspective view of a further embodiment of the present invention utilizing an elevated base section.

Turning to FIG. 3 and FIG. 4, a further embodiment of the present invention 110 is illustrated. This embodiment contemplates the use of an elevated base section 114. The use of the elevated base section 114 serves to further protect and isolate the surface upon which the beverage base cooler 10 is placed, from condensation created by the beverage container and the platform 16. Furthermore, this elevated section 114 may be formed from metal, cork, plastic, rubber, or any other material that is suitable for elevating the platform 116 above the support surface upon which the present invention 110 is resting. In one embodiment, the elevated base section 114 comprises a hollow annular section that attaches to the bottom of the platform 116, as shown in FIG. 4. It is also contemplated that the elevated base section 114 and the platform 16 are formed as a single unified section. This base section 114 may comprise any shape, size or configuration suitable for isolating the platform 116 from the surface upon which the present invention 110 rests. Additionally, this elevated section may be integrated into the design of the present invention 110, or it may be comprised of a separate, detachable section.

Figure 5:
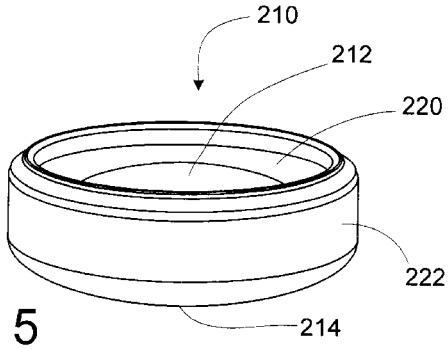
FIG. 5 is a perspective view of a further embodiment of the present invention comprising longitudinally extended inner and outer wall sections.

In a further embodiment, FIG. 5 illustrates a beverage base cooler 210 that retains all of the configuration characteristics as mentioned in the aforementioned embodiments, but further utilizes a longitudinally extended inner and outer wall 220, 222. By extending the inner wall 220 and the outer wall 222 longitudinally, the present invention 210 is capable of providing additional cooling capacity to a greater portion of the unconsumed beverage that resides within the beverage container. Additionally, this embodiment of the present 210 is able to provide additional support and protection against the toppling of the beverage container while it is inserted within the contoured cavity 212 of the present invention 210.

In use, the beverage cooling device of the present invention may be held to the bottom portion of a beverage container by frictional forces between the inner surface of the beverage cooling device and the outer surface of the beverage container. The frictional forces will allow the cooling device to remain on the beverage container when the container is lifted by a user to take a drink. The frictional forces between the container and the cooling device are preferably strong enough to allow that cooling device to remain on the container when the container is lifted but to also allow the cooling device to be easily removed from the container. It is also contemplated that the fit between the beverage cooling device and the beverage container be more loose such that when the container is lifted for drinking purposes, the beverage container will be lifted out of the cooling device and the device will remain resting on a surface.

The foregoing disclosure is illustrative of the present invention and is not to be construed as limiting thereof. Although one or more embodiments of the invention have been described, persons of ordinary skill in the art will readily appreciate that numerous modifications could be made without departing from the scope and spirit of the disclosed invention. As such, it should be understood that all such modifications are intended to be included within the scope of this invention. The written description and drawings illustrate the present invention and are not to be construed as limited to the specific embodiments disclosed.

What is claimed is:

1. A beverage coaster for cooling a beverage stored within a beverage container, comprising:

a base having the approximate size of a standard beverage can, including, a top wall having a radial curve contoured to engage a bottom portion of the beverage can;

a bottom wall;

at least one side wall connected to the bottom wall and the top wall, wherein a height of the side wall is less than a width of the base; and a predetermined amount of cooling material disposed between the top wall and the bottom wall.

2. A beverage cooling device as recited in claim 1, further comprising an elevated section connected to the bottom of the outer wall.

3. A beverage cooling device as recited in claim 1, further comprising a base that is connected to the bottom of the outer wall.

4. A beverage cooling device as recited in claim 1, wherein the inner and outer walls are formed from a single unified section.

5. A beverage cooling device as recited in claim 1, wherein the outer wall has a cross section of sufficient area to prevent condensation from forming when a beverage is inserted within the device.

6. A beverage cooling device as recited in claim 1, wherein the inner wall has a cross-section suitable for maximizing thermal transfer to the beverage container.

* * * * *